US005443557A

United States Patent [19]

Hasegawa

[11] Patent Number: 5,443,557

[45] Date of Patent: Aug. 22, 1995

[54] PRINTING DRUM ASSEMBLY FOR A STENCIL PRINTING DEVICE

[75] Inventor: Takanori Hasegawa, Tokyo, Japan

[73] Assignee: Riso Kagaku Corporation, Tokyo, Japan

[21] Appl. No.: 242,986

[22] Filed: May 16, 1994

[30] Foreign Application Priority Data

May 25, 1993 [JP] Japan ..... 5-122648

[51] Int. Cl.[6] ..... B41L 13/04; B41L 13/18

[52] U.S. Cl. ..... 101/119; 101/116; 101/123; 101/129

[58] Field of Search ..... 101/116, 119, 120, 123, 101/129

[56] References Cited

U.S. PATENT DOCUMENTS

| | | | |
|---|---|---|---|
| 3,845,712 | 11/1974 | Lewicki, Jr. | 101/129 |
| 3,892,176 | 7/1975 | Van der Winden | 101/116 |
| 3,949,666 | 4/1976 | Zimmer | 101/119 |
| 3,986,450 | 10/1976 | Zimmer | 101/115 |
| 4,510,863 | 4/1985 | Blaak et al. | 101/119 |
| 4,612,874 | 9/1986 | Mitter | 101/119 |

FOREIGN PATENT DOCUMENTS

| | | |
|---|---|---|
| 56-72987 | 6/1981 | Japan . |
| 59-12893 | 1/1984 | Japan . |
| 62-42873 | 2/1987 | Japan . |
| 2164576 | 6/1990 | Japan . |
| 3254985 | 11/1991 | Japan . |

*Primary Examiner*—Edgar S. Burr
*Assistant Examiner*—Lynn D. Hendrickson
*Attorney, Agent, or Firm*—Dickstein, Shapiro & Morin

[57] ABSTRACT

A printing drum is rotatable supported by a fixed hollow cylindrical member at two axially spaced positions thereof so that the printing drum may be supported in a highly stable fashion and any mis-alignment of the printing drum can be avoided. Also, the interior of the fixed hollow cylindrical member provides an easily accessible space for accommodating a printing ink container and a pump for supplying printing ink. In particular, by using a squeegee blade instead of a squeegee roller, a particularly advantage can be obtained because the diameter of the fixed hollow cylindrical member can be such that an annular chamber defined between the fixed hollow cylindrical member and the inner circumferential surface of the printing drum is barely sufficient to accommodate the squeegee blade in the annular chamber, and the fixed hollow cylindrical member can provide a highly rigid support structure.

10 Claims, 5 Drawing Sheets

PRINTING DRUM ASSEMBLY FOR A STENCIL PRINTING DEVICE

TECHNICAL FIELD

The present invention relates to a printing drum assembly for a stencil printing device, and in particular to a printing drum assembly for a single-drum rotary stencil printing device.

BACKGROUND OF THE INVENTION

Squeegee type single-drum rotary printing devices are widely used as one type of single-drum rotary stencil printing devices, and comprise a cylindrical printing drum including an ink permeable outer shell on which a stencil master plate is mounted, and a squeegee member consisting of a squeegee roller or a squeegee blade engaging with the inner surface of the outer shell of the printing drum. As the printing drum or, in particular, the outer shell rotates, printing ink is squeezed through or across the ink permeable outer shell by the squeegee member which is stationary.

According to the conventional printing drum structure disclosed in Japanese patent laid-open publication (kokai) No. 3-254985, the two axial ends of the outer shell are closed by end walls, and the outer shell is rotatably supported by a central shaft passed through the central parts of these end walls. The squeegee member is supported by the central shaft.

According to the alternate conventional structure disclosed in Japanese patent laid-open publication (kokai) No. 59-12893, the printing drum having an open end is rotatably supported at its outer circumference adjacent to its open end by a fixed side plate in the manner of a cantilever, and a fixed frame securely attached to the side plate projects into the interior of the printing drum. The squeegee member is mounted on this fixed frame for engagement with the inner surface of the outer shell of the printing drum.

Single-drum rotary stencil printing devices not using any squeegee member are also known, and printing drums having a central shaft for use in such stencil printing drums are disclosed in Japanese patent laid-open publications (kokai) Nos. 56-72987, 62-42873, 59-12893 and 2-164576. According to this group of conventional stencil printing devices, the two ends of the printing drum are closed by end walls, and the central shaft is passed centrally through these end walls.

According to the printing drum having end walls and a central shaft passed through these end walls, because the printing drum is supported at its two axial ends, the printing drum is relatively free from any eccentricity or mis-alignment in the overall structure, and can be supported in a stable fashion. Furthermore, because the interior of the printing drum is entirely enclosed by the end walls, the printing ink is favorably confined within the printing drum, and would not leak out even during transportation of the printing drum. However, the enclosed structure of the printing drum would not allow easy access to the interior of the printing drum, and an ink bottle serving as a source for printing ink cannot be readily replaced. Also, when the squeegee angle and the squeegee pressure are to be adjusted, the printing drum has to be dismantled. Normally, it is not possible to adjust the squeegee angle and the squeegee pressure while the printing drum is mounted on the stencil printing device.

According to the cantilever type printing drum for a stencil printing device, because one of the axial ends of the printing drum is open, an ink bottle placed inside the printing drum can be readily replaced, and the squeegee angle and the squeegee pressure can be adjusted while the printing drum is mounted on the stencil printing drum. On the other hand, due to the nature of the mode of supporting the printing drum, it is not easy to support the printing drum in a stable fashion, and there is an increased possibility of involving eccentricity. If there is an excessive eccentricity in the printing drum, it will cause unevenness in the density of the printed images. Furthermore, there is an increased possibility of causing leakage of printing ink from the interior of the printing ink, in particular when the printing drum is placed vertically with its open end down. Leakage of printing drum should be avoided because it will smear the clothing of the operator and other parts. Furthermore, because the interior of the printing drum consists of a single chamber, and there is no separating wall between the squeegee member assembly and the ink bottle/pump assembly, printing ink which has leaked from the squeegee member assembly may smear the various parts of the ink bottle/pump assembly. Possibility of smearing the clothing of the operator will seriously reduce the acceptability of the stencil printing device for office use.

According to the printing drum for a single-drum stencil printing device not using a squeegee member, the printing drum is substantially enclosed with the two axial ends of the printing drum closed by end walls, and a central shaft is passed through these end walls. However, the printing ink used for such printers has a relatively low viscosity, and tends to seep through the outer shell of the printing drum under the action of gravity. Therefore, according to this type of printing drums, the rest position of the printing drum must be selected such that a non-ink permeable part of the printing drum be located at the bottom end of the printing drum whenever the printing drum is brought to a stop.

BRIEF SUMMARY OF THE INVENTION

In view of such problems of the prior art, a primary object of the present invention is to provide a printing drum assembly for a single drum type rotary stencil printing device which is simple in structure and which can be supported in a stable fashion without reducing the accessibility to the interior of the printing drum.

A second object of the present invention is to provide a printing drum assembly which is free from the seeping out of printing ink even when the printing ink has a relatively low viscosity, and can thus eliminate the need to stop the printing drum always precisely at a predetermined angular position.

According to the present invention, these and other objects can be accomplished by providing a printing drum assembly for a stencil printing device, comprising: a fixed hollow cylindrical member supported by a frame of a stencil printing device; a printing drum rotatably supported by the fixed hollow cylindrical member at two axially spaced positions thereof, the printing drum including an ink permeable outer shell; a printing ink container disposed inside the fixed hollow cylindrical member; and printing ink supplying means for feeding printing ink from the printing ink container to an inner circumferential surface of the printing drum.

Thus, the printing drum is supported at axially spaced positions thereof in a highly stable fashion so that any mis-alignment of the printing drum can be avoided, and the interior of the fixed hollow cylindrical member provides an easily accessible space for accommodating a printing ink container and printing ink supplying means such as pumps and valves. In particular, by using a squeegee blade instead of a squeegee roller, a particularly advantage can be obtained because the diameter of the fixed hollow cylindrical member can be such that an annular chamber defined between the fixed hollow cylindrical member and the inner circumferential surface of the printing drum is barely sufficient to accommodate the squeegee blade in the annular chamber, and the fixed hollow cylindrical member can provide a highly rigid support structure.

In case of a squeegee-less printing drum, the fixed hollow cylindrical member easily allows a highly liquid tight structure which prevents seeping or leaking of printing ink from the printing drum. It is particularly advantageous, if the supplying means is reversed immediately after the printing device is stopped so that the printing ink remaining on the inner circumferential surface of the printing ink may be safely returned to the ink container inside the fixed hollow cylindrical member so as to eliminate any possibility of printing ink leakage.

The fixed hollow cylindrical member may be either fixedly secured to a frame at two axial ends thereof, or fixedly secured to a frame at an axial end thereof in the manner of a cantilever.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
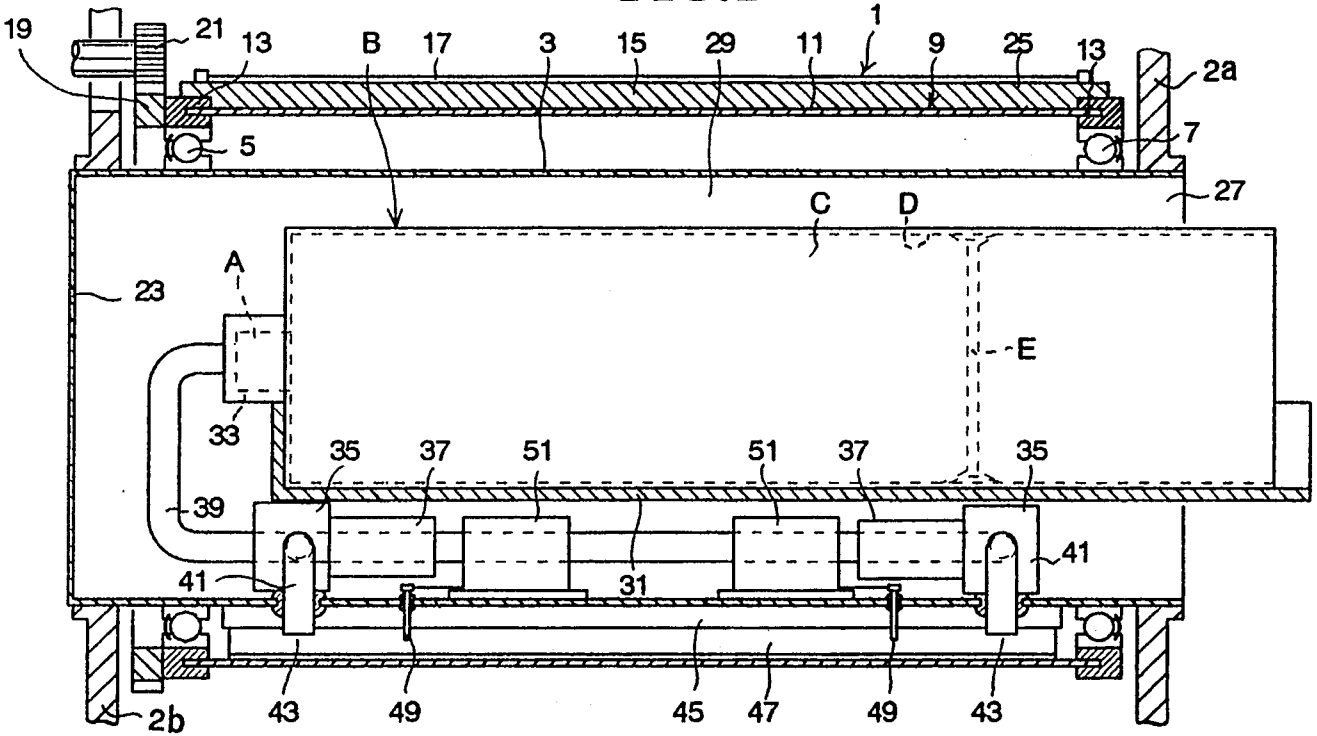
FIG. 1 is a longitudinal sectional view of a first embodiment of the printing drum assembly for a stencil printing device according to the present invention.
Figure 2:
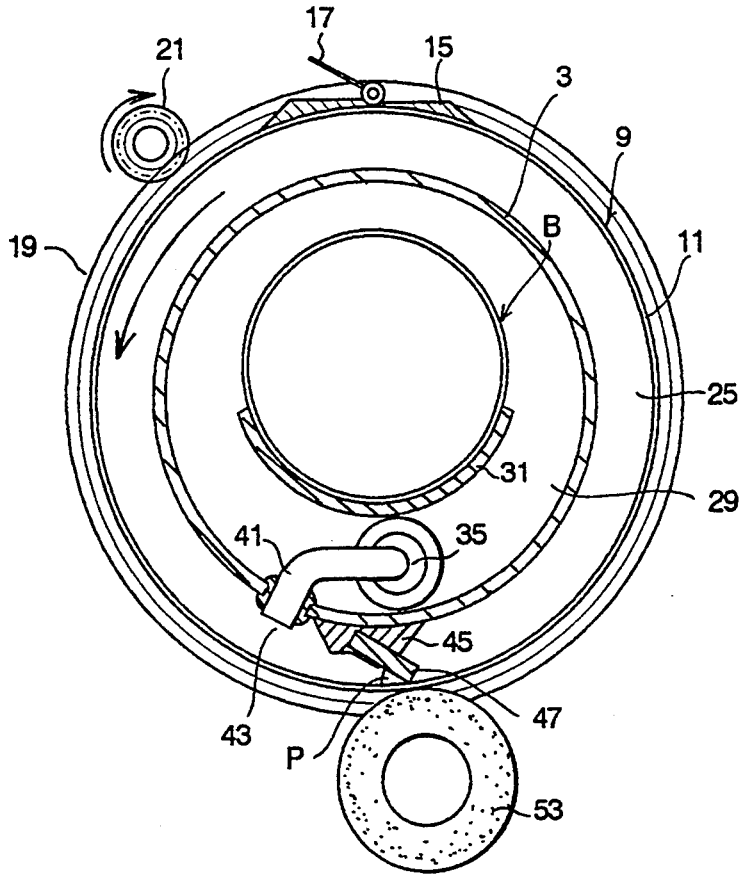
FIG. 2 is a cross sectional view of the printing drum assembly of FIG. 1.

FIGS. 1 and 2 show a first embodiment of the printing drum assembly for a stencil printing device according to the present invention. The printing drum assembly which is generally denoted with numeral 1 comprises a hollow cylindrical member 3 which is fixedly secured to a pair of side plates *2a* and *2b* at its two axial ends, and a cylindrical printing drum 9 coaxially fitted on the fixed cylindrical member 3 via a pair of roller or ball bearings 5 and 7 at two axial ends of the printing drum 9.

If the printing drum assembly 1 is a permanent type which is not intended for replacement by the user, the hollow cylindrical member 3 may be fixedly secured to a fixed frame of a printing device. If the printing drum 1 is a detachable type which can be axially drawn out for replacement by the user, for instance as disclosed in Japanese patent publication (kokoku) No. 62-28758, the fixed hollow cylindrical member 3 may be fixedly secured to a detachable frame which can be selectively removed from the main frame of the printing device.

The printing drum 9 essentially consists of a cylindrical shell 11 and a pair of annular support members 13 engaged with two axial end portions of the cylindrical shell 11, and is rotatably supported on the cylindrical member 3 in a coaxial relationship via the annular support members 13, and the ball bearings 5 and 7.

A master plate clamp 17 is provided in a flat segment 15 of the printing drum 9, and a master plate sheet is mounted around the outer circumferential surface of the printing drum 9 with an end of the master plate sheet engaged by the master plate clamp 17. The outer shell 11 is provided with an ink permeable structure, for instance consisting of a metallic shell provided with a minute porous structure except for the flat segment 15 and its surrounding region.

A ring gear 19 is fixedly secured to one of the annular support members 13 coaxially with the cylindrical shell 11, and a drive gear 21 rotatively driven by an electric motor not shown in the drawing meshes with the ring gear 19. The drive gear 21 turns in clockwise direction as seen in FIG. 2, and the printing drum 9 therefore turns in counter clockwise direction around its axial center line.

The fixed hollow cylindrical member 3 has an open first end, and a second end which is closed by an end wall 23. The cylindrical member 3 has an outer diameter which is smaller than the inner diameter of the cylindrical shell 9 by the size of the bearings 5 and 7. The printing drum is thus rotatably supported by the fixed cylindrical member 3 via the ball bearings 5 and 7, all in a coaxial relationship. For the purpose of sealing off an annular chamber 25 defined between the fixed cylindrical member 3 and the outer shell 9 of the printing drum 9, the roller bearings 5 and 7 are provided with seals.

The fixed hollow cylindrical member 3 internally defines a cylindrical chamber 29 which is separated from the annular chamber 25, and has an open end 27 at the fixed axial end. The internal cylindrical chamber 29 has a relatively large volume which is determined by the diameter of the fixed hollow cylindrical member 3, and accommodates therein an ink bottle retaining assembly 31 for replaceably holding an ink bottle B introduced into the cylindrical chamber 29 from its open end 27. The ink bottle retaining assembly 31 comprises an ink bottle connection portion 33 which can engage with an ink outlet A of the ink bottle B.

The ink bottle B comprises a cylindrical bottle main body C having the ink outlet A at its one end, and a moveable bottom plate E is axially slidably received in the bottle main body C so as to serve as a piston defining an ink chamber D and displace the printing ink out of the ink outlet A.

The cylindrical chamber 29 further accommodates therein a pair of ink supply pumps 35, and a pair of motors 37 for driving the ink supply pumps 35. The ink supply pumps 35 each have an inlet which is connected to the ink bottle connecting portion 33 via an ink conduit 39. The outlets of the ink supply pumps 35 are connected to ink supply conduits 41 which are passed through the fixed hollow cylindrical member 3, and extend into the annular chamber 25. The free end of each of the ink supply conduits 41 is located in the annular chamber 25.

To the outer circumferential surface of the cylindrical member 3 is secured a squeegee blade mount assembly 45 which carries a squeegee blade 47. The radial dimension necessary to accommodate the squeegee blade 47 is provided by the overall thickness of the two rings of the ball bearings 5 and 7 as seen in the radial direction. In other words, the radial dimension of the annular chamber 25 is selected to be barely sufficient to accommodate the squeegee blade 47 therein.

The squeegee blade 47 is made of rubber or rubber-like material, and engages the inner circumferential surface of the cylindrical shell 11 of the printing drum 9 at a prescribed squeegee angle and a prescribed squeegee pressure. The squeegee blade mount assembly 45 is provided with means for adjusting the squeegee angle and squeegee pressure of the squeegee blade 47 from the end of the cylindrical member 3.

As best shown in FIG. 2, the free end 43 of each of the ink supply conduits 41 is located behind the point of contact between the squeegee blade 47 and the cylindrical shell 11 as seen in the rotational direction of the printing drum 9, and printing ink is expelled from each of the ink supply conduits 41 onto the inner circumferential surface of the cylindrical shell 11 of the printing drum 9 so that a small lump of printing ink or an ink reservoir P is formed in an wedge-like gap defined between the inner circumferential surface of the cylindrical shell 11 of the printing drum 9 and the squeegee blade 47. The amount of printing ink in the ink reservoir P is detected by a pair of electrostatic capacitance type ink amount sensor 51 each comprising an ink amount detecting needle 49, and the operation of the motors 37 is controlled according to the amount of ink detected by the ink amount sensors 51. The ink amount sensors 51 may have a similar structure as that of the one disclosed in Japanese utility model publication (kokoku) No. 3-28342, and the electric circuit for the sensor 51 and the drive circuit from the motor 27 may be disposed in the cylindrical chamber 29 defined inside the fixed cylindrical member 3.

According to this structure, as the drive gear 21 rotates in clockwise direction as seen in FIG. 2, the printing drum 9 rotates in counter-clockwise direction around its axial center line with its two axial ends supported by the fixed hollow cylindrical member 3.

When the amount of ink in the ink reservoir P detected by the ink amount sensors 51 in this condition falls below a prescribed level, the ink supply pumps 35 are driven by the electric motors 37, and the printing ink is drawn from the ink bottle B connected to the ink bottle connecting portion 33 by the ink supply pumps 35, and is metered to the ink reservoir P via the ink supply conduits 41.

In the illustrated embodiment, the ink supply pumps 35, the electric motors 37, the ink supply conduits 41, and the ink amount sensors 51 are arranged in the regions adjacent to the axial ends of the printing drum, and the two sensors individually detect the amount of printing ink in the parts of the ink reservoir P adjacent to the axial ends, and individually control the two motors 37 and hence the two ink supply pumps 35 so that the amount of the printing ink may be made uniform over the entire ink reservoir P. In FIG. 2, numeral 53 denotes a press roll.

Although the two axial ends of the fixed cylindrical member 3 were supported by a fixed frame 2*a* and 2*b* in the above described embodiment, it is also possible to support only one axial end of the fixed cylindrical member 3 with a frame 2*a* in the manner of a cantilever. Because the fixed cylindrical member 3 has a large diameter with various mechanisms for supplying printing ink accommodated therein, it is possible to ensure a sufficient structural rigidity even when it is supported only at one axial end thereof.

Figure 3:
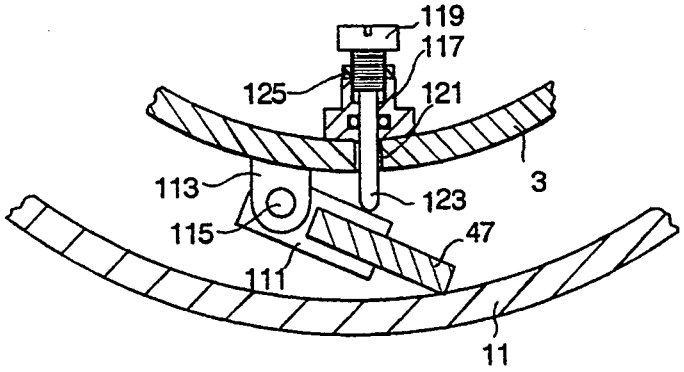
FIG. 3 is an enlarged sectional view showing a mechanism for adjusting the squeegee angle in the printing drum assembly according to the present invention.

FIG. 3 shows an example of the mechanism for adjusting the squeegee angle of the squeegee blade 47. The squeegee blade 47 is mounted on a blade support member 111 which is vertically pivotably mounted on a bracket 113 fixedly secured to the outer circumferential surface of the fixed cylindrical member 3, via a pivot shaft 115. In other words, the squeegee blade 47 is pivotably mounted on the cylindrical member 3 via the blade support member 111 so that the squeegee angle around the pivot shaft 115 along with the squeegee pressure can be adjusted.

For this purpose, an adjust screw support block 117 is fixedly mounted on the inner circumferential surface of the fixed cylindrical member 3 for threadably engaging an adjust screw 119 thereto. The adjust screw 119 is passed through an opening 121 provided in the fixed cylindrical member 3, and is provided with a push rod portion 123 for abutting the blade support member 111 at its free end. The adjust screw 119 may be locked into a position with a lock nut 125 threadably engaged therewith.

According to this adjust mechanism, the push rod portion 123 moves vertically as the adjust screw 119 is threaded into and out of the adjust screw support block 117, and the blade support member 111 is moved by the push rod portion 123 by a corresponding amount so that a desired change in the squeegee angle and squeegee pressure may be accomplished.

Figure 4:
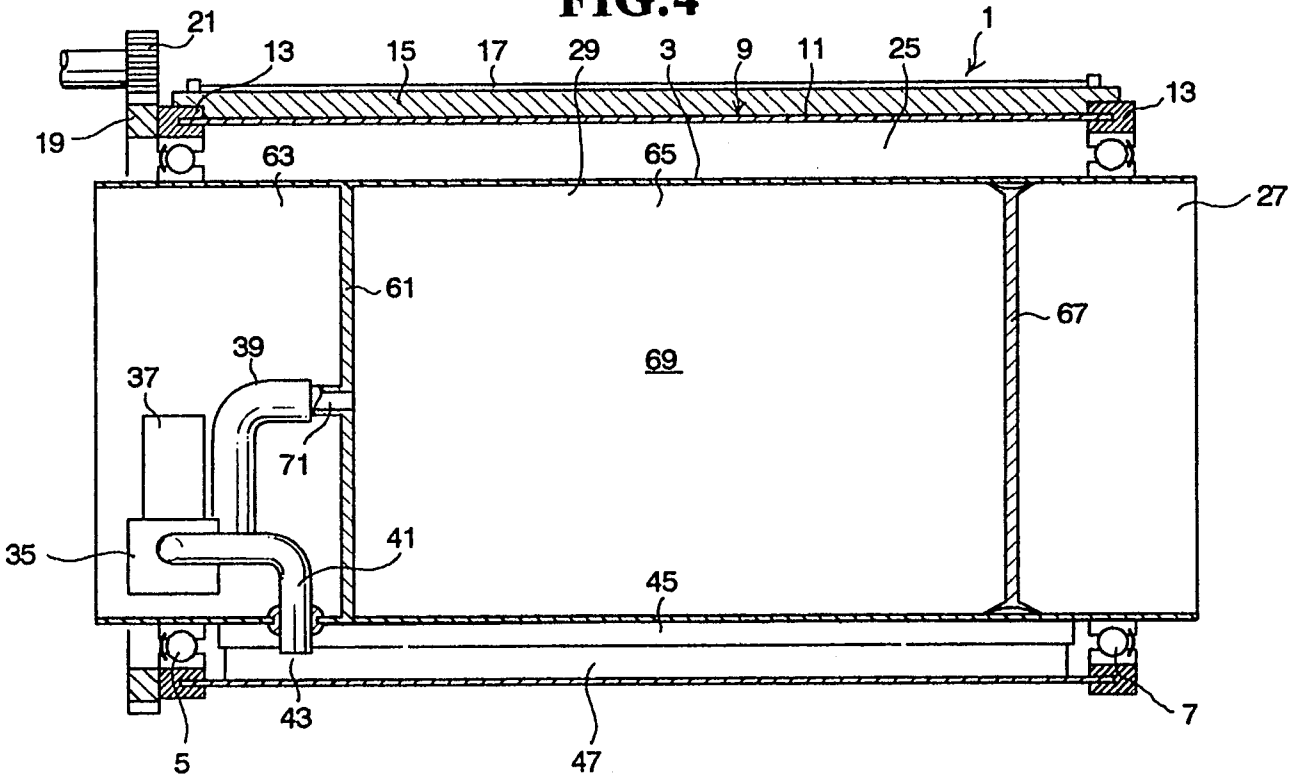
FIGS. 4 through 6 are views similar to FIG. 1 showing different embodiments of the printing drum assembly for a stencil printing device according to the present invention.

FIG. 4 shows a second embodiment of the present invention. In FIG. 4, the parts corresponding to those of the first embodiment are denoted with like numerals.

In this embodiment, the fixed cylindrical member 3 is divided into a pump chamber 63 and an ink bottle chamber 65 by a partition wall 61. The pump chamber 63 accommodates therein an ink supply pump 35, a motor 37 and an ink supply conduit 41. The ink bottle chamber 65 accommodates therein a piston member 67 disposed in an axially slidable manner, thereby defining an ink receiving chamber 69 between the piston member 67 and the partition wall 61. The partition wall 61 is provided with an ink outlet 71 which is connected to an ink conduit 39 leading to the inlet of the ink supply pump 35. According to this embodiment, the fixed cylindrical member 3 itself serves as an ink bottle having a relatively large capacity.

Figure 5:
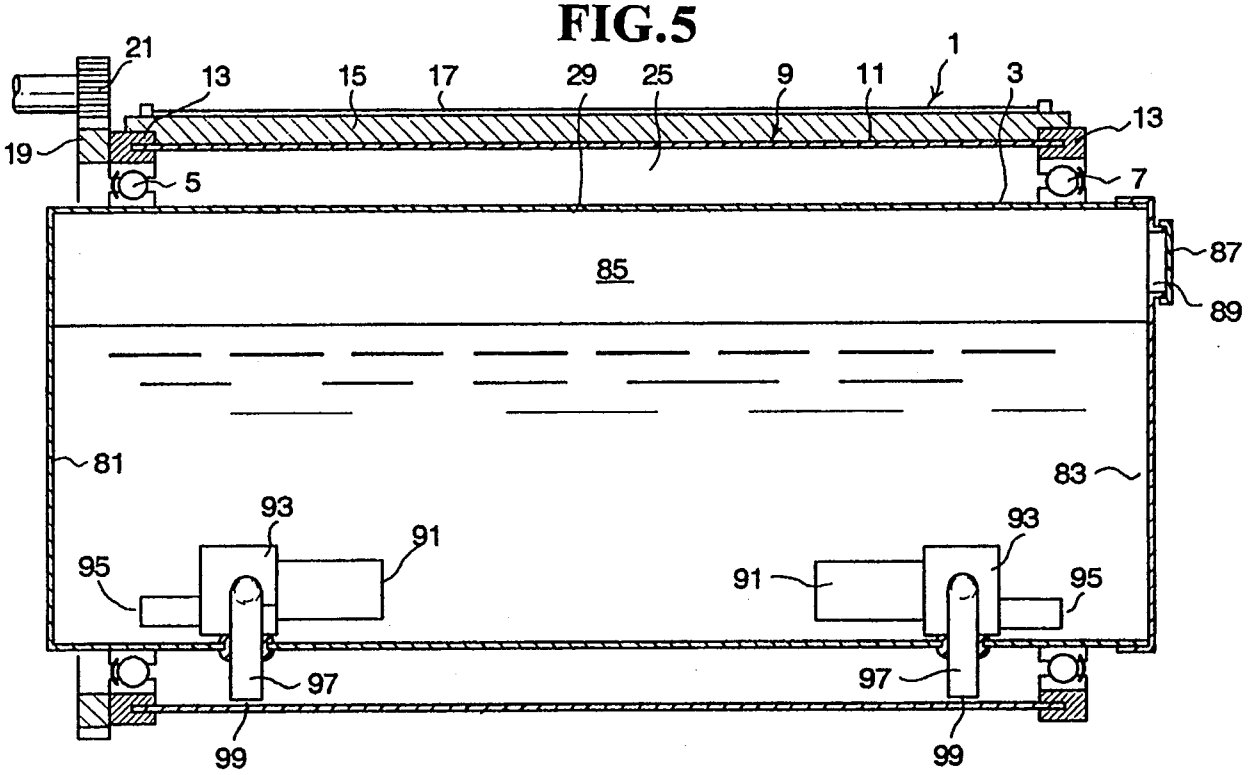
Figure 6:
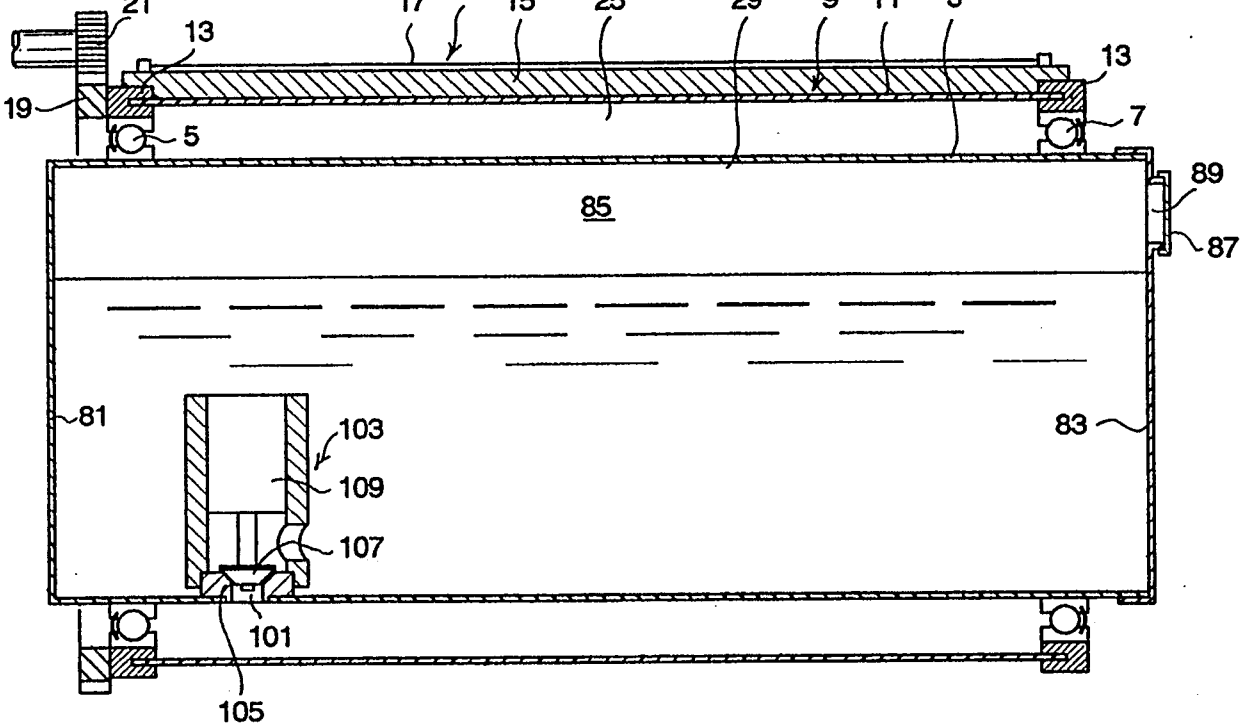

FIGS. 5 and 6 show third and fourth embodiments of the printing drum assembly according to the present invention applied to a squeegee-less printing drum. In FIGS. 5 and 6, the parts corresponding to those of the previous embodiments are denoted with like numerals. According to these embodiments, the fixed hollow cylindrical member 3 is provided with an enclosed structure with its axial ends closed by end walls 81 and 83, internally defining an ink receiving chamber 85. Printing ink can be replenished into the ink receiving chamber 85 from an opening 89 provided in one of the end walls 83 and normally closed by a cap 87.

In the embodiment illustrated in FIG. 5, a pair of ink pump 93 are provided inside the ink receiving chamber 85, and are actuated by corresponding electric motors 91. The inlets 95 of the ink pumps 93 open into the ink receiving chamber 85. The outlets of the ink pumps 93 are connected to ink supply conduits 97 which are passed through the outer wall of the fixed hollow cylindrical member 3 and extends into the annular chamber 25. The free end 99 of each of the ink supply conduits 97 is placed adjacent to the inner circumferential surface of the printing drum 9 in the annular chamber 25.

In the embodiment illustrated in FIG. 5, the ink pumps 93 are selectively actuated by the electric motors 91, and the printing ink in the ink receiving chamber 85 is drawn by the ink pumps 93 and is delivered or metered to the annular chamber 25 or, more specifically, the inner circumferential surface of the printing drum 9, via the ink supply conduits 97. When the printing device is stopped operative, the ink pumps 93 may be reversed by the motors 91 so that the printing ink remaining in the annular chamber 25 may be drawn back to the ink receiving chamber 85.

The recovery of printing ink by the reversing of the pumps can be employed also in a printing drum equipped with a squeegee member by placing the free ends 43 of the ink supply conduits 41 close to the ink reservoir P.

In the embodiment illustrated in FIG. 6, the fixed hollow cylindrical member 3 is provided with an ink outlet 101 which opens into the annular chamber 25, and is adapted to be opened and closed by a solenoid valve 103. The solenoid valve 103 comprises a valve element 107 which can sit on a valve seat 105 and close the ink outlet 101, and a solenoid 109 for actuating the valve element 107.

The solenoid valve 103 may be a simple valve for simply opening and closing the ink outlet 101, but may also be a flow control valve which can control the lift of the valve element 107 by way of the solenoid 109, and can control the opening of the ink outlet 101 through continuous or stepwise control of the solenoid 109. In either case, the amount of ink supply to the inner circumferential surface of the printing drum 9 can be controlled according to the opening and closing or the opening area of the ink outlet 101.

In the embodiments illustrated in FIGS. 5 and 6, a squeegee blade 47 is disposed inside the annular chamber 25 similarly as the embodiments illustrated in FIGS. 1 and 4.

In each of the above described embodiments, the amount of printing ink in the ink reservoir P, or the inner circumferential surface of the printing drum 9 can be detected in a number of ways beside from the method based on the use of an electrostatic capacitance type ink amount sensor 51. For instance, the ink suction type ink amount detecting device disclosed in Japanese patent laid-open publication (kokai) No. 4-195316 can be used.

Thus, according to the printing drum of the present invention, because the printing drum is supported at its two axial ends by a fixed hollow cylindrical member, mis-alignment of the rotational center of the printing drum can be minimized, and the printing drum can be supported in a highly stable manner. Also, a relatively large chamber can be defined inside the fixed hollow cylindrical member, and this chamber can be conveniently used for accommodating a printing ink receiving tank or bottle and means for supplying printing ink. Thus, the present invention allows the printing device to be a highly compact unit. In particular, using the interior of the fixed hollow cylindrical member as an ink receiving tank is highly advantageous.

Because the means for feeding or supplying printing ink and the inner circumferential surface of the cylindrical shell of the printing drum are separated from each other by the wall of the fixed hollow cylindrical member, the various units are safely accommodated in the cylindrical chamber inside the fixed hollow cylindrical member, and are prevented from being smeared by the printing ink. Furthermore, because the annular chamber defined between the fixed hollow cylindrical member and the printing drum is well sealed, leakage of printing ink from the printing drum can be avoided even during transportation. However, easy access to the various units of the printing drum can be ensured through the open end of the fixed hollow cylindrical member, and fine adjustment of the squeegee angle and squeegee pressure can be carried out without dismantling the printing drum.

In case of a squeegee-less printing drum which uses highly fluid printing ink, the printing ink is safely received inside the fixed hollow cylindrical member which is separated from the inner circumferential surface of the printing drum, and is supplied and metered to the inner circumferential surface of the cylindrical shell of the printing drum. Therefore, no substantial amount of printing ink remains on the inner circumferential surface of the cylindrical shell of the printing drum when the printing device is not operative. In particular, the amount of printing ink remaining on the inner circumferential surface can be further reduced by drawing the printing ink back into the cylindrical chamber by reversing the ink supply pump. Thus, seeping of printing ink through the outer shell of the printing drum under the action of gravity can be avoided, and the need for stopping the printing drum at a prescribed angular position for preventing such a seeping of printing ink can be eliminated.

Although the present invention has been described in terms of specific embodiments, it is possible to modify and alter details thereof without departing from the spirit of the present invention.

What we claim is:

1. A printing drum assembly for a stencil printing device, comprising:

a frame of a stencil printing device;

a hollow cylindrical member fixed to and supported by said frame;

a printing drum having an inner circumferential surface rotatably supported by said hollow cylindrical member at two axially spaced positions thereof, said printing drum including an ink permeable outer shell;

a printing ink container disposed inside said hollow cylindrical member; and printing ink supplying means for feeding printing ink from said printing ink container to said inner circumferential surface of said printing drum.

2. A printing drum assembly according to claim 1, wherein said hollow cylindrical member is fixedly secured to said frame at two axial ends thereof.

3. A printing drum assembly according to claim 1, wherein said hollow cylindrical member has an open end at a first axial end and a closed end at a second axial end.

4. A printing drum assembly according to claim 1, further comprising a squeegee blade supported by said hollow cylindrical member and engaging said inner circumferential surface of said printing drum.

5. A printing drum assembly according to claim 4, wherein an annular chamber defined between said hollow cylindrical member and said inner circumferential surface of said printing drum is barely sufficient to accommodate said squeegee blade in said annular chamber.

6. A printing drum assembly according to claim 4, including an adjust screw threadably passed through a wall of said hollow cylindrical member and a member supporting said squeegee blade, said adjust screw having a free end which abuts said member supporting said squeegee blade.

7. A printing drum assembly for a stencil printing device comprising:

a frame of a stencil printing device;

a hollow cylindrical member fixed to and supported by said frame;

said hollow cylindrical member serving as a container for printing ink;

a printing drum having an inner circumferential surface rotatably supported by said hollow cylindrical member at two axially spaced positions thereof, said printing drum including an ink permeable outer shell; and printing ink supplying means for feeding printing ink from said printing ink container to said inner circumferential surface of said printing drum.

8. A printing drum assembly according to claim 1, wherein said printing ink supplying means comprises a pump for feeding printing ink received in said container to said inner circumferential surface of said printing drum.

9. A printing drum assembly according to claim 1, including an annular chamber defined between said hollow cylindrical member and said inner circumferential surface of said printing drum wherein said printing ink supplying means comprises a solenoid valve provided on an opening provided in said hollow cylindrical member for selective communication between said container for printing ink and said annular chamber.

10. A printing drum assembly according to claim 1, wherein said hollow cylindrical member is fixedly secured to said frame at an axial end thereof in the manner of a cantilever.

* * * * *